US011141780B2

(12) United States Patent
Meyer et al.

(10) Patent No.: US 11,141,780 B2
(45) Date of Patent: Oct. 12, 2021

(54) METHOD AND DEVICE FOR CASTING METAL ALLOY INGOTS

(71) Applicant: Aleris Rolled Products Germany GmbH, Koblenz (DE)

(72) Inventors: Philippe Meyer, Koblenz (DE); Johannes Morscheiser, Dörth (DE)

(73) Assignee: Aleris Rolled Products Germany GmbH, Koblenz (DE)

( * ) Notice: Subject to any disclaimer, the term of this patent is extended or adjusted under 35 U.S.C. 154(b) by 323 days.

(21) Appl. No.: 15/768,172

(22) PCT Filed: Oct. 10, 2016

(86) PCT No.: PCT/EP2016/074200
§ 371 (c)(1),
(2) Date: Apr. 13, 2018

(87) PCT Pub. No.: WO2017/063993
PCT Pub. Date: Apr. 20, 2017

(65) Prior Publication Data

US 2018/0304347 A1 Oct. 25, 2018

(30) Foreign Application Priority Data

Oct. 14, 2015 (EP) ..... 15189789

(51) Int. Cl.
*B22C 9/08* (2006.01)
*B22D 23/00* (2006.01)
(Continued)

(52) U.S. Cl.
CPC ..... *B22D 7/064* (2013.01); *B22C 9/086* (2013.01); *B22D 2/006* (2013.01); *B22D 7/005* (2013.01);
(Continued)

(58) Field of Classification Search
CPC .. B22D 23/006; B22D 27/045; B22D 43/004; B22D 39/026; B22C 9/086
(Continued)

(56) References Cited

U.S. PATENT DOCUMENTS 1,734,313 A 11/1929 Von Malmborg
1,926,573 A * 9/1933 Willcox ..... B22D 23/006 164/513

(Continued)

FOREIGN PATENT DOCUMENTS

GB 1164173 A 9/1969
WO 2014190366 A1 12/2014
WO 2015100465 A1 7/2015

OTHER PUBLICATIONS

International Search Report and Written Opinion dated Feb. 2, 2017 for PCT/EP2016/074200 to Aleris Rolled Products Germany Gmbh filed Oct. 10, 2016.

(Continued)

*Primary Examiner* — Kevin E Yoon
(74) *Attorney, Agent, or Firm* — Kilpatrick Townsend & Stockton LLP

(57) ABSTRACT

A method of casting a metal alloy ingot, including the following steps: providing a one side open-ended mould including a plurality of sides and a bottom plate defining a mould cavity with a mould opening, the open-ended mould being pivotable around a horizontal rotational axis between a position so that the mould opening points upwards and a position so that the mould opening points side-wards or down-wards; positioning the open-ended mould such that the mould opening points side-wards or down-wards; providing a casting container with an upwardly positioned aperture; filling the casting container with molten metal for one casting operation; coupling the casting container to the open-ended mould so that the casting container is located
(Continued)

below the mould while the mould opening points side-wards or down-wards; rotating the open-ended mould together with the casting container around the horizontal rotational axis for approximately 90° to 180° from a position whereby the mould opening points side-wards or down-wards to a position whereby the mould opening points upwards such that the molten metal is conveyed through the mould opening into the open-ended mould until reaching a desired thickness, whereby the molten metal in the open-ended mould is cooled directionally through its thickness where the solidification front remains substantially monoaxial.

17 Claims, 2 Drawing Sheets

(51) Int. Cl.

| | |
|---|---|
| ***B22D 27/04*** | (2006.01) |
| ***B22D 7/06*** | (2006.01) |
| ***B22D 7/00*** | (2006.01) |
| ***B22D 21/00*** | (2006.01) |
| ***B22D 27/00*** | (2006.01) |
| ***B22D 2/00*** | (2006.01) |
| ***B22D 27/06*** | (2006.01) |

(52) U.S. Cl.
CPC ..... *B22D 21/007* (2013.01); *B22D 23/006* (2013.01); *B22D 27/003* (2013.01); *B22D 27/045* (2013.01); *B22D 27/06* (2013.01)

(58) Field of Classification Search
USPC ..... 164/136, 336
See application file for complete search history.

(56) References Cited

U.S. PATENT DOCUMENTS

| | | | | |
|---|---|---|---|---|
| 2,897,555 | A * | 8/1959 | Nishikiori | B22D 23/006 164/72 |
| 3,333,625 | A * | 8/1967 | Fromson | B22D 23/006 164/136 |
| 4,708,326 | A * | 11/1987 | Brockmeyer | B22D 35/04 266/159 |
| 4,733,714 | A * | 3/1988 | Smith | B22D 27/08 164/130 |
| 5,335,711 | A * | 8/1994 | Paine | B22D 27/13 164/120 |
| 8,448,690 | B1 | 5/2013 | Sawtell et al. | |
| 9,895,743 | B2 * | 2/2018 | Rathner | B22D 41/04 |
| 2004/0045693 | A1 * | 3/2004 | Watanabe | B22D 27/04 164/122.1 |
| 2012/0325424 | A1 * | 12/2012 | Morikawa | B22D 23/006 164/348 |
| 2014/0110077 | A1 * | 4/2014 | White | B22D 23/006 164/47 |
| 2015/0239042 | A1 | 8/2015 | Morikawa et al. | |
| 2016/0221079 | A1 * | 8/2016 | Goettsch | B22D 35/04 |

OTHER PUBLICATIONS

International Alloy Designations and Chemical Composition Limits for Wrought Aluminum and Wrought Aluminum Alloys, Registration Record Series Teal Sheeets, The Aluminium Association, (2015).

European Application No. 16788042.6, Notice of Decision to Grant, dated Nov. 12, 2020, 2 pages.

* cited by examiner

METHOD AND DEVICE FOR CASTING METAL ALLOY INGOTS

CROSS-REFERENCE TO RELATED APPLICATIONS

This is a § 371 National Stage Application of International Application No. PCT/EP2016/074200 filed on Oct. 10, 2016, claiming the priority of European Patent Application No. 15189789.9 filed on Oct. 14, 2015.

FIELD OF THE INVENTION

The present invention relates to a method of casting a metal alloy ingot wherein a casting mould for accommodating a metal melt is used resulting in monoaxial solidification. The invention further relates to a casting system in particular for carrying out the method.

BACKGROUND OF THE INVENTION

As will be appreciated herein below, except as otherwise indicated, aluminium alloy designations and temper designations refer to the Aluminium Association designations in Aluminium Standards and Data and the Registration Records, as published by the Aluminium Association in 2015 and well known to the persons skilled in the art.

U.S. Pat. No. 8,448,690 (Alcoa) discloses a complex method for producing an ingot with variable composition using planar solidification. Molten metal is fed via a horizontal launder system, which is adjustable in height, into a mould cavity. The height of the launder is adjusted to the metal level in the mould to avoid free falling surfaces and turbulences. The melt composition is varied by feeding sequentially at least two metals from different sources into the mould cavity. The resultant is an ingot with variable alloy composition in the length direction of the ingot. The bottom of the mould cavity is provided with a plurality of cooling jets, for example air/water jets, located below the bottom, and are structured to spray coolant against the bottom surface of the substrate. The substrate can be perforated allowing the cooling media to directly contact the solidifying ingot. The rate at which molten metal flows into the mould cavity and the rate at which coolant is applied to the bottom are both controlled to provide unidirectional solidification. The coolant may begin as air, for example, and then gradually be changed from air to an air-water mist, and then to water.

There is a need for a method of producing an ingot solidified in a monoaxial way which is less complex.

DESCRIPTION OF THE INVENTION

It is an object of the present invention to provide a method of casting a metal alloy ingot having been monoaxially solidified.

It is another object of the present invention to provide a method of casting an aluminium alloy ingot having been monoaxially solidified.

It is yet another object of the present invention to provide a casting system for casting a metal alloy ingot having been monoaxially solidified.

These and other objects and further advantages are met or exceeded by the present invention providing a method of casting a single metal alloy ingot, in particular a monolithic ingot, the method comprising the steps of:

(i) providing an on one side open-ended mould comprising a plurality of sides and a bottom plate defining a mould cavity, and whereby the mould cavity is devoid of any cores or core package as frequently used in foundry castings, said open-ended mould being pivotable around a horizontal rotational axis between a position so that the mould opening points upwards and a position so that the mould opening points side-wards or down-wards, and wherein the bottom plate of the mould is preferably provided with temperature control means, in particular with coolant means to distract in a controlled manner the heat away from the solidifying metal through the bottom plate;

(ii) positioning the open-ended mould such that the mould opening points side-wards or down-wards;

(iii) providing a casting container with an upwardly positioned aperture;

(iv) filling said casting container with molten metal for one casting operation;

(v) coupling the casting container to the open-ended mould so that the casting container is located below the mould while the mould opening points side-wards or down-wards;

(vi) rotating the open-ended mould together with the casting container around the horizontal axis for approximately 45° to 180°, preferably, 90° or 180°, as the case may be, from a position whereby the mould opening points side-wards or down-wards to a position whereby the mould opening points upwards such that the molten metal is conveyed, preferably in a non-turbulent and in a laminar manner, into the open-ended mould until a desired thickness or desired metal level height; thus the mould is being rotated until said casting container is positioned substantially above said mould and said mould cavity; and (vii) whereby the molten metal in the open-ended mould is cooled directionally through its thickness where the solidification front remains substantially monoaxial and substantially parallel to the bottom plate of the mould.

In an optional next step the method further comprises the step (viii) of releasing the casting container from its coupled position and removing the casting container from the filed open-ended mould. On a less preferred basis the casting container remains coupled to the open-ended mould and is only detached for maintenance purposes.

The present invention provides a method and a casting system for producing an monoaxially solidified ingot, and cooling the ingot at a controlled, relatively constant cooling rate. The method provides an alternative for Direct Chill (DC-) casting to produce an ingot for wrought alloys. The method combines a dedicated mould with a tilt casting approach and reduces or eliminates macro-segregation of the various alloying elements in the metal alloy. In addition, the monoaxial solidification has proven to be beneficial for manufacturing ingots from in particular high-strength aluminium wrought alloys which tend to be very crack sensitive with regard to the development of cold and hot cracks during casting. The method can be used to cast crack sensitive AA2000-series alloys, including Al—Cu—Li alloys, and AA7000-series alloys. The casting operation and in particular the control of the metal flow is significantly simpler compared to the method disclosed in U.S. Pat. No. 8,448,690. Furthermore, the temperature control of the mould sides and the bottom plate leaves more flexibility with regard to the cooling conditions and therefore the control of the microstructure in the ingot. The method requires no consumables and is therefore very cost efficient.

In an embodiment of the invention the metal alloy is an aluminium alloy and more preferably aluminium wrought alloys which can be subsequently subjected to further hot and/or cold working operations. Suitable aluminium alloy composition include alloys of the AA series 1000, 2000, 3000, 4000, 5000, 6000, 7000, and 8000.

The invention can be used to cast cylindrical ingots which can be subsequently processed in for example an extrusion or forging process. However, in a preferred embodiment of the invention it is used to manufacture rectangular ingots which can be subsequently processed by means of a rolling or forging operation. An ingot is cast preferably with in minimum dimension (thickness) perpendicular to the bottom plate. To that effect the open-ended mould consists of four sides together defining a rectangular shape, optionally with rounded corner points, and which are positioned upwards from the bottom plate of the mould. On a less preferred basis the four sides may define a substantially square shape.

In an embodiment the filling and holding of the molten metal in the casting container and/or the conveying of the molten metal from the casting container to the open-ended mould is performed under a protective gas atmosphere, for example using an inert gas like for example argon. More preferably the protective gas atmosphere has been dried in advance, as is known in the art. This further avoids the entrapment of undesirable gas, hydrogen, nitrogen and oxygen in particular, or formation of oxides in the molten metal, in particular when using aluminium alloys.

In an embodiment the filling and holding of the molten metal in the casting container and/or the conveying of the molten metal from the casting container to the open-ended mould is performed under a protective salt cover. Optionally a protective salt cover can be used in combination with a protective gas atmosphere.

In an embodiment of the invention the molten metal prior to being conveyed to the casting mould is being degassed in the container via a degasser or other means for removing hydrogen or other undesirable elements from the molten metal, including, for example sodium, potassium, or calcium. Alternatively, the degasser can treat the molten metal outside the casting container and the degassed molten metal is transferred back into the casting container.

In an embodiment of the invention the molten metal when conveyed from the casting container to the casting mould flows through a filter, such as for example a ceramic foam filter or other means for removing non-metallic inclusions, for example oxides.

In an embodiment of the invention the bottom plate is made of a metal having a high thermal conductivity, for example copper or aluminium, and is preferably provided with one or more cooling channels for flowing cooling medium passage, for example water or a mixture of water and air. The bottom plate allows for a controlled, relatively constant cooling rate of the metal ingot.

Thermocouples can be positioned in the bottom plate to monitor the heat transfer and be used to control the flow rate of the cooling medium in the cooling channels to provide unidirectional solidification through the thickness of the ingot during progressing solidification.

The bottom plate can be provided with an ejection system to facilitate removal of the solidified ingot from the open-ended mould.

The sides of the open-ended mould are preferably made of a refractory material and should limit as much as possible any heat loss. To avoid or at least limit any heat loss via the sides these can be provided with temperature control means.

The term "refractory material" as used herein is intended to include all materials that are relatively resistant to attack by molten metals, in particular molten aluminium alloy, and that are capable of retaining their strength at the high temperatures contemplated for the mould. Such materials include, but are not limited to, ceramic materials (inorganic non-metallic solids and heat-resistant glasses) and nonmetals. A non-limiting list of suitable materials includes the following: the oxides of aluminum (alumina), silicon (silica, particularly fused silica), magnesium (magnesia), calcium (lime), zirconium (zirconia), boron (boron oxide), metal carbides, borides, nitrides, silicides, such as silicon carbide, nitride-bonded silicon carbide (SiC/Si3N4), boron carbide, boron nitride; aluminosilicates, e.g. calcium aluminum silicate, composite materials (e.g. composites of oxides and non-oxides), glasses, including machinable glasses, mineral wools of fibers or mixtures thereof, carbon or graphite, and the like.

Preferred refractory materials are based on alumina, silica or sialon, as these are commonly used in a cast-shop and readily available.

The sides of the open-ended mould can be made of steel, optionally with a thin refractory coating. To avoid or at least limit any heat loss via the sides these can be provided with thermal bridges or with heating elements and temperature control means to maintain a pre-set temperature.

The sides of the open-ended mould can be removable to ease the extraction of the final solidified ingot.

Furthermore, to limit any heat loss via the sides of the mould and the top surface of the molten metal in the open-ended mould, there can be provided one or more additional external heat sources to introduce heat to the surface of the molten metal. Appropriate heat sources are electrical heating oil heating or gas fired heating.

The invention further relates to a casting system for carrying out the method, the casting system comprising an on one side open-ended mould comprising a plurality of sides and a bottom plate defining a mould cavity, said open-ended mould being pivotable mounted around a horizontal rotational axis between a position so that the mould opening points upwards and a position so that the mould opening points side-wards or down-wards, and wherein optionally at least one of the sides of the mould is provided with temperature control means, and wherein the bottom plate of the mould is provided with coolant means; and a casting container with an upwardly positioned aperture pivotable mountable around the horizontal rotational axis.

DESCRIPTION OF THE DRAWINGS

The invention shall also be described with reference to the appended drawings, in which.

Figure 1C:
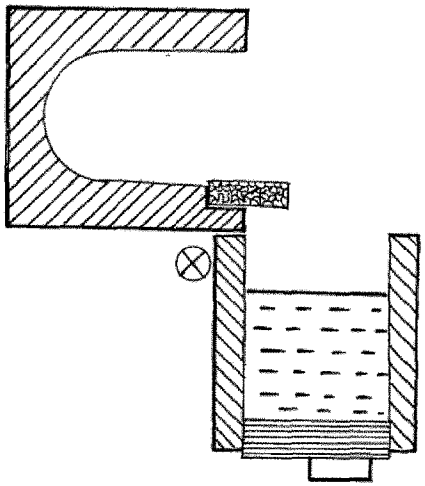
FIG. 1A to FIG. 1C show a partial cross-sectional schematic representation of the casting system used for the method.
Figure 1B:
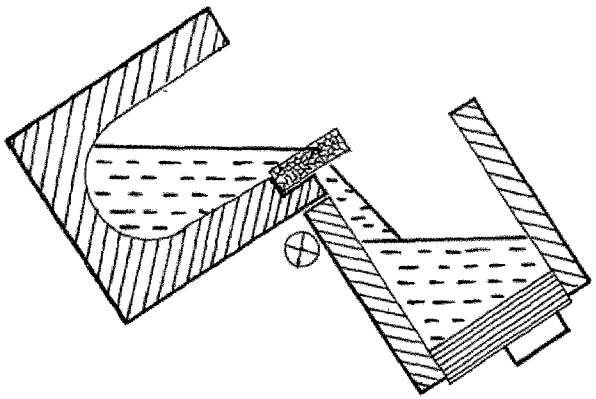
Figure 1A:
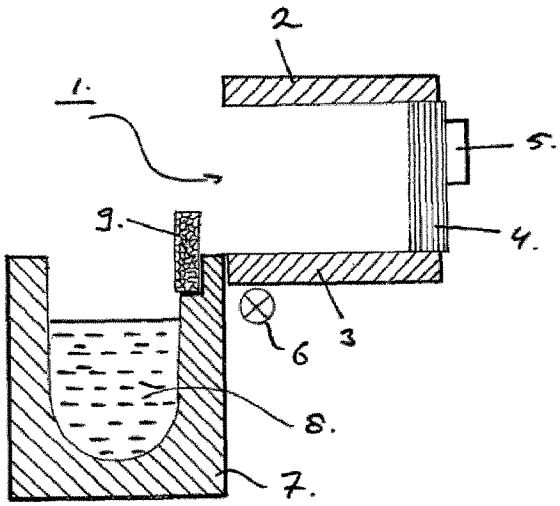

In the method according to this invention there is provided an on one side open-ended mould (1) comprising a plurality of sides (2,3) and a bottom plate (4) defining a mould cavity. The open-ended mould (1) is pivotable around a horizontal rotational axis (6) between a position so that the mould opening points upwards (see FIG. 1C) and a position so that the mould opening points side-wards (see FIG. 1A) or down-wards (non-shown), and wherein at least the side (2) of the mould (1) is provided with temperature control means (not shown) and the bottom plate of the mould is provided with temperature control means, in particular with coolant means (5). In addition there is provided a casting container (7) filled with a molten metal (8) for one casting operation. The casting container could be a ladle or a melting furnace. In the method the open-ended mould (1) is positioned such that the mould opening points side-wards (see FIG. 1A). At this step the mould (1) is empty and clean. In a next step the casting container (7) is coupled to the open-ended mould (1) so that the casting container is located below the mould (1) while the mould opening points side-wards. Next (see FIG. 1B) rotating or tilting the open-ended mould (1) together with the casting container (7) around the horizontal axis (6) for at least 45°, and preferably approximately 90°, to a position wherein the mould opening points upwards such that the molten metal is conveyed into the open-ended mould until a desired thickness (see FIG. 1C). When the molten metal is being conveyed progressively to the open-ended mould is may flow through a ceramic foam filter (9) for removing non-metallic inclusions in the molten metal and the creation of turbulence is to be avoided. When the molten metal is in the open-ended mould by extracting heat via the bottom plate (4) it is cooled directionally through its thickness where the solidification front remains substantially monoaxial.

Figure 2C:
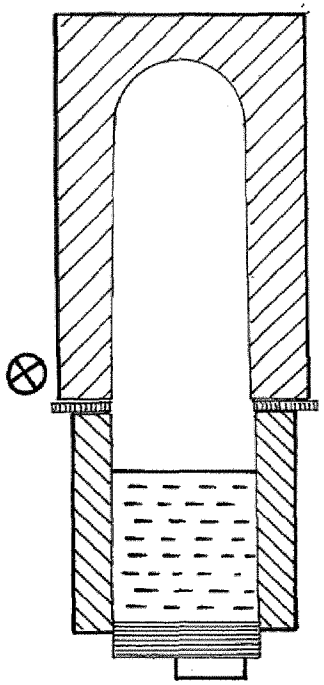
FIG. 2A to FIG. 2C show a partial cross-sectional schematic representation of another embodiment of the casting system used for the method.
Figure 2B:
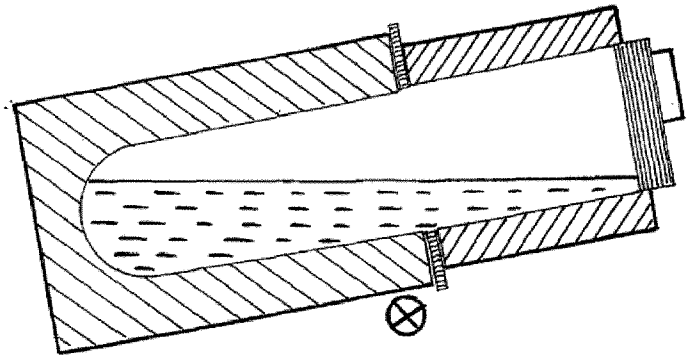
Figure 2A:
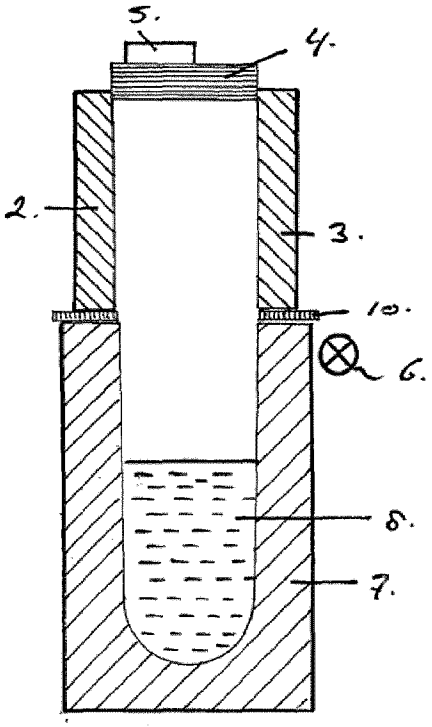

In another embodiment of the method the open-ended mould (1) is positioned initially such that the mould opening points down-wards. The feature numbering in FIG. 2A is the same as for FIG. 1A. In practice this would mean that the mould is located substantially above the casting container (7) (see FIG. 2A). In a next step (see FIG. 2B) the mould and the casting container are being rotated or tilted around a horizon axis (6) for approximately 180° to a position wherein the mould opening points upwards such that the molten metal is conveyed into the open-ended mould until a desired thickness (see FIG. 2C). In this embodiment of the method the open-ended mould can be coupled or connected to the casting container via a seal (10). This would allow for an improved control of the atmosphere above the molten metal, for example by using an inert gas environment, and results in a reduced hydrogen pick-up in the molten metal. This would allow the casting of alloys which are very sensitive to any hydrogen or nitrogen pick-up such as Al—Mg—Li and Al—Cu—Li alloys.

The invention is not limited to the embodiments described before, which may be varied widely within the scope of the invention as defined by the appending claims.

The invention claimed is:

1. A method of casting a metal alloy ingot, comprising the following steps:

providing a one side open-ended mould comprising a plurality of sides and a bottom plate defining a mould cavity with a mould opening, the open-ended mould being pivotable around a horizontal rotational axis between a position so that the mould opening points upwards and a position so that the mould opening points side-wards or down-wards, and wherein the bottom plate of the mould is provided with coolant means;

positioning the open-ended mould such that the mould opening points side-wards or down-wards;

providing a casting container with an aperture and positioning the casting container such that the aperture points upwardly;

filling said casting container with molten metal for one casting operation;

coupling the casting container to the open-ended mould so that the casting container is located below the mould while the mould opening points side-wards or down-wards; and rotating the open-ended mould together with the casting container around the horizontal rotational axis for approximately 45° to 180°, from a position whereby the mould opening points side-wards or down-wards to a position whereby the mould opening points upwards such that the molten metal is conveyed through the aperture of the casting container, through a ceramic foam filter and into the open-ended mould until reaching a desired thickness, wherein the ceramic foam filter is supported at an end of the casting container defining the aperture and extends outwards from the end of the casting container and is spaced apart from the mould opening of the mould, whereby the molten metal in the open-ended mould is cooled directionally through its thickness where a solidification front remains substantially monoaxial.

2. The method according to claim 1, wherein the metal alloy is an aluminium alloy.

3. The method according to claim 1, wherein the open-ended mould consists of four sides positioned upwards from the bottom plate of the mould.

4. The method according to claim 1, wherein at least one of the sides of the mould is provided with thermal bridges or heating elements.

5. The method according to claim 1, wherein the bottom plate of the mould is made from a metal.

6. The method according to claim 1, further comprising releasing the casting container from the coupled position and removing the casting container from the mould.

7. The method according to claim 1, wherein a surface of the molten metal in the open-ended mould is heated via an external heat source.

8. The method according to claim 1, wherein at least the conveying of the molten metal from the casting container to the open-ended mould is carried out under a protective gas atmosphere.

9. The method according to claim 1, wherein at least the conveying of the molten metal from the casting container to the open-ended mould is carried out under a protective salt layer.

10. The method according to claim 1, wherein the metal alloy is an aluminium wrought alloy.

11. The method according to claim 1, wherein the bottom plate of the mould is provided with cooling channels for cooling medium passage.

12. The method according to claim 1, wherein the open-ended mould is rotated together with the casting container around the horizontal rotational axis for approximately 90° to 180°, from the position whereby the mould opening points side-wards or down-wards to the position whereby the mould opening points upwards such that the molten metal is conveyed through the mould opening into the open-ended mould until reaching the desired thickness.

13. The method according to claim 12, wherein the metal alloy is an aluminium alloy, wherein the open-ended mould consists of four sides positioned upwards from the bottom plate of the mould, wherein at least one of the sides of the mould is provided with thermal bridges or heating elements, wherein the bottom plate of the mould is made from a metal, wherein the method further comprises the step of releasing the casting container from the coupled position and removing the casting container from the mould.

14. The method according to claim 13, wherein the surface of the molten metal in the open-ended mould is heated via an external heat source.

15. The method according to claim 13, wherein at least the conveying of the molten metal from the casting container to the open-ended mould is carried out under a protective gas atmosphere.

16. The method according to claim 13, wherein at least the conveying of the molten metal from the casting container to the open-ended mould is carried out under a protective salt layer.

17. A method of casting a metal alloy ingot, comprising the following steps:

providing a one side open-ended mould comprising a plurality of sides and a bottom plate defining a mould cavity with a mould opening, the open-ended mould being pivotable around a horizontal rotational axis between a position so that the mould opening points upwards and a position so that the mould opening points side-wards, and wherein the bottom plate of the mould is provided with coolant means;

positioning the open-ended mould such that the mould opening points side-wards;

providing a casting container with an aperture and positioning the casting container such that the aperture points upwards and not facing the mould opening while the mould opening points side-wards;

filling said casting container with molten metal for one casting operation;

coupling the casting container to the open-ended mould so that the casting container is located below the mould while the mould opening points side-wards or downwards; and rotating the open-ended mould together with the casting container around the horizontal rotational axis for approximately 90° to 180°, from a position whereby the mould opening points side-wards to a position whereby the mould opening points upwards such that the molten metal is conveyed through the aperture of the casting container, through a ceramic foam filter and into the open-ended mould until reaching a desired thickness, wherein the ceramic foam filter is supported at an end of the casting container defining the aperture and extends outwards from the end of the casting container and is spaced apart from the mould opening of the mould, whereby the molten metal in the open-ended mould is cooled directionally through its thickness where a solidification front remains substantially monoaxial.

* * * * *